US005476413A

United States Patent [19]

Hasegawa et al.

[11] Patent Number: 5,476,413

[45] Date of Patent: Dec. 19, 1995

[54] APPARATUS FOR POLISHING THE PERIPHERY PORTION OF A WAFER

[75] Inventors: Fumihiko Hasegawa; Tatsuo Ohtani; Yasuyoshi Kuroda, all of Fukushima; Koichiro Ichikawa; Yasuo Inada, both of Nagano, all of Japan

[73] Assignees: Shin-Etsu Handotai Co., Ltd., Tokyo; Fujikoshi Machinery Corp., Nagano, both of Japan

[21] Appl. No.: 306,439

[22] Filed: Sep. 19, 1994

[30] Foreign Application Priority Data

Sep. 30, 1993 [JP] Japan ..... 5-268096

[51] Int. Cl.[6] ..... B24B 9/00

[52] U.S. Cl. ..... 451/168; 451/44

[58] Field of Search ..... 451/41, 44, 216, 451/218, 221, 226–227, 168, 176, 491, 492, 493, 502, 169, 43, 162, 163, 59, 307

[56] References Cited

U.S. PATENT DOCUMENTS

| | | | |
|---|---|---|---|
| 2,258,733 | 10/1941 | Brackett | 451/176 |
| 3,806,956 | 4/1974 | Supkis et al. | 451/59 |
| 5,117,590 | 6/1992 | Kudo et al. | 451/44 |
| 5,148,639 | 9/1992 | Sakai et al. | 451/59 |
| 5,185,965 | 2/1993 | Ozake | 451/44 |
| 5,209,027 | 5/1993 | Ishida et al. | 451/59 |
| 5,271,185 | 12/1993 | Hosokawa | 451/44 |
| 5,316,620 | 5/1994 | Hasegawa et al. | 156/645 |

FOREIGN PATENT DOCUMENTS

| | | |
|---|---|---|
| 0549143 | 6/1993 | European Pat. Off. . |
| 2321981 | 3/1977 | France . |
| 53029759 | 5/1992 | Japan . |
| 57184662 | 11/1992 | Japan . |

*Primary Examiner*—Bruce M. Kisliuk
*Assistant Examiner*—Derris Banks
*Attorney, Agent, or Firm*—Lowe, Price, Leblanc & Becker

[57] ABSTRACT

An apparatus for polishing the periphery portion of a wafer, by which improvement on the polishing velocity may be effected and besides a more efficient spatial usage of the working layer of an abrasive tape is capable, comprising a tape holding fixed abrasive grains thereon; a feed reel for feeding the tape stored by winding itself; a take-up reel for taking up the tape by winding itself; a rotary drum inside of which both of the reels are equipped in such a manner that they are mountable or demountable, where a portion of the tape in the way from the feed reel to the take-up reel is adaptive to wind the rotary drum around the outer cylindrical surface thereof in close contact in the shape of a helicoid and one of the main faces of the wafer is positioned to be in a plane intersecting the central axis of the rotary drum at an angle.

6 Claims, 3 Drawing Sheets

APPARATUS FOR POLISHING THE PERIPHERY PORTION OF A WAFER

BACKGROUND OF THE INVENTION

1. Field of the Invention

The present invention relates to an apparatus for polishing a wafer and more particularly to an apparatus for polishing the chamfered portion along the periphery of the wafer.

2. Description of the Prior Art

Conventionally a silicon single crystal wafer, a compound semiconductor wafer or the like (hereinafter referred to as a wafer) is provided with a chamfered portion along the periphery of the wafer by grinding off the periphery portion.

A wafer with the thus ground off chamfer is not free from generation of fine particles thereon in being handled physically or even in mask alignment in a semiconductor device fabricaton process, though it may prevent the chamfer of its own from cracking and chipping off. Therefore, the wafer with the grinding finish on the chamfer is subject to reduce a yield of devices in semiconductor device fabrication as well as deteriorate the reliability in performance. Under such circumstances, it has been a traditional way to have the chamfer of grinding finish polished.

In the polishing, the ground chamfer is generally pressed to a polishing buff which is rotating about its axis and at that same time the polishing spot is fed with a polishing slurry (fine abrasive grains) which is composed of an alkaline solution with colloidal silica dispersed therein.

When the polishing slurry is fed to the polishing spot on the chamfer of a wafer, the slurry is sprayed on other parts than the polishing spot (for instance a front face or back face of the wafer) and thereby the corrosive action of the alkaline substance included in the slurry gives birth to surficial flaws in the area affected by the alkaline substance. These flaws are not able to be removed away in a cleaning step which is applied to the wafer to get rid of the slurry residue. The flaws on the front face of the wafer is not problematic since a mirror-polishing is applied to the front face and thereby the flaws are removed together with a stock polished off, but to this contrary, those on the back face are left unaffected as it was all the way through the last stage of a wafer fabrication on the product and becomes a new particle source in the following stages and thereby the yield in a semiconductor device fabrication is adversely affected as well as the characteristics of devices thus produced are degraded.

In view of this situation, an apparatus for polishing the periphery portion of a wafer is recently contrived which uses an abrasive tape, which means a tape supporting fixed abrasive grains thereon instead of an apparatus in which a wafer is polished with the help of a polishing slurry. In the former apparatus, the problem of flaws on the back face of a wafer does not occur due to lack of a polishing slurry including an alkaline substance. However, this apparatus does not replace loss of the abrasive grains on an abrasive tape with new ones during operation at a working spot, which differs from the free-abrasive-grain polishing above mentioned in this point of argument, and therefore the loss of the fixed abrasive grains and loading of the abrasive layer take place faster, when the same and one abrasive tape is repeatedly used. Consequently it is indispensable in polishing a chamfer by an abrasive tape that a fresh face of the tape should be always fed to a polishing spot on the chamfer so that the polishing may be effectively executed.

In an apparatus for polishing the chamfer of a wafer, which uses a tape holding fixed abrasive grains, the following contrivance has been made that a feed reel feeds a fresh face of the tape to the polishing spot in succession all the time and thereby the polishing does not fail to be effected by a fresh face as well as a already used face continues to be pulled away and the tape is then wound a take-up reel.

An polishing apparatus of this type is schematically shown in FIG. 4. The polishing apparatus 10 includes a wafer holder 11, a feed reel 12 to feed a tape 14 and a take-up reel 13 to wind the used portion of the tape. With the apparatus 10, the tape 14 is fed by the feed reel 12, a fresh face of the tape 14 is continuously brought to contact the polishing spot and a used face thereof is in succession pulled away to be wound by the take-up reel 13, while the tape 14 is tried to use the full width. On the other hand the wafer is kept on rotating as it is held by wafer holder 11 during polishing, so that the rotation may give rise to a relative velocity between the chamfer of the wafer and the tape.

However a polishing apparatus of this type have had the following problems to be solved.

In polishing by an abrasive tape, important conditions are the feed velocity of the tape and the relative velocity between the tape and the working spot on the chamfer under polishing for effective polishing.

The above mentioned polishing apparatus is adapted to freely adjust the velocity of the tape at an operator's option and thereby the fresh face of the abrasive tape is fed at a variable velocity to the working spot. However, specially in the step of processing the orientation flat portion of the wafer, there remains an unsolved problem that a velocity of the tape relative to the working spot is not able to reach a enough value to polish the chamfer since the relative velocity is dependent on not the rotational motion of the wafer but the motion of the tape in side-way oscillation. What's more, in the step of processing the round peripheral portion, there are such problems as the rotating wafer is subject to vibrate due to frequent decentralized vacuum-chucking on a stage or the full width of a tape is unable to utilize in order to make the finish all over a chamfer uniform and good in quality.

SUMMARY OF THE INVENTION

The present invention was made in view of the above-mentioned problems and it is an object to present an apparatus for polishing the peripheral portion of a wafer, in which a polishing velocity is improved and an effective use of an tape is realized.

An polishing apparatus according to the present invention is for polishing the periphery portion of a wafer, which comprises a tape holding abrasive grains thereon; a feed reel feeding the tape wound itself; a take-up reel taking up the tape from the feed reel; a rotary drum inside which both of the reels are equipped such that the reels are mountable or demountable; a first motor to drive the rotary drum to rotate, where the portion of the tape in the way from the feeding reel to the take-up reel is arranged to wind in close contact the rotary drum around the outside cylindrical surface thereof in the shape of a helicoid and the wafer is positioned so as to make one of the main faces of the wafer to be in or in parallel with a plane which intersects the central axis of the rotary drum at an angle not being equal to zero.

In this case, the abrasive tape is wound in close contact the rotary drum therearound in the shape of a helicoid and besides the tape moves relative to the rotary drum by the winding action of the take-up reel, so that a fresh face of the tape is always fed in succession to the cylindrical surface and thereby the relative velocity between the working spot of the chamfer and the tape becomes large enough to have the chamfer polished properly.

BRIEF DESCRIPTION OF THE DRAWINGS

Other features and objects of the present invention will become apparent from a study of the following description of an apparatus for polishing the peripheral portion of a wafer together with the accompanying drawings, of which.

DETAILED DESCRIPTION OF THE PREFERRED EMBODIMENT

Below described in reference to the drawings is an apparatus for polishing the periphery portion of a wafer embodying the present invention.

Figure 1:
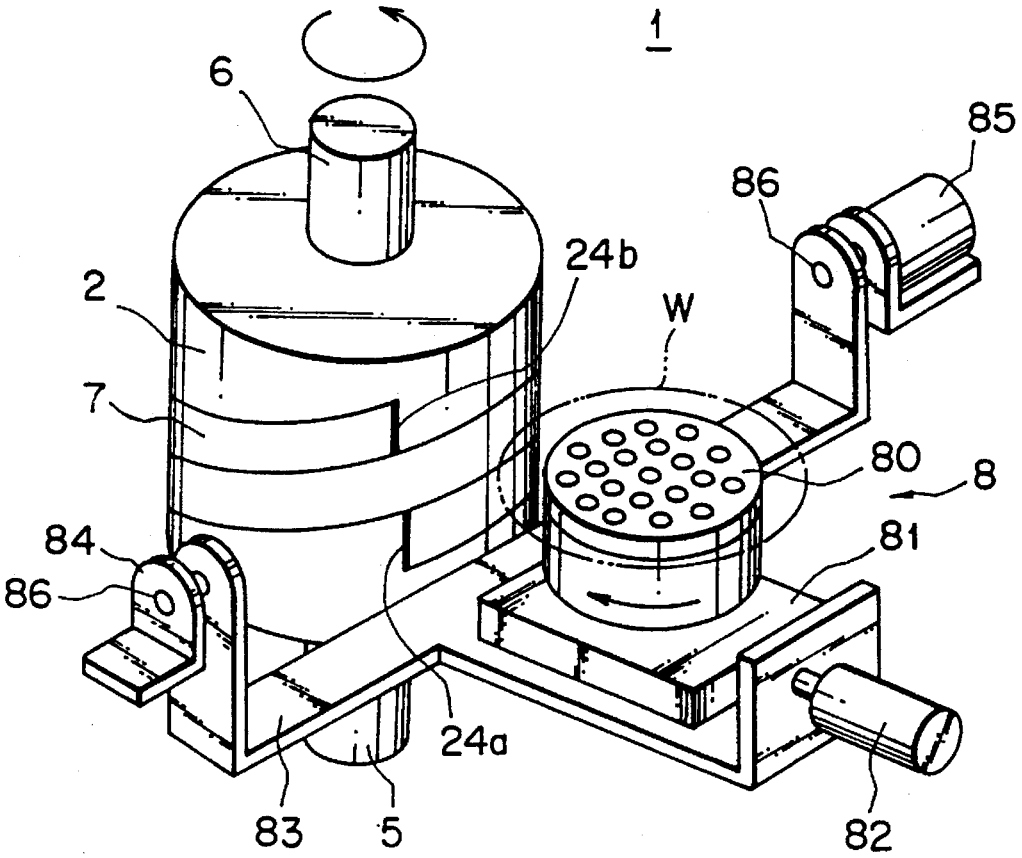
FIG. 1 is a perspective view illustrating the main parts constructing an apparatus for polishing the periphery portion of a wafer embodying the present invention.

In FIG. 1, shown is a perspective view of an embodiment of an polishing apparatus. The polishing apparatus comprises a rotary drum 2, a feed reel 3 for feeding an abrasive tape 7 and a take-up reel 4 for winding the tape 7 itself, both of them being equipped inside the drum 2 (FIG. 2), and a motor 6 for driving the take-up reel to rotate about its axis, where the abrasive tape 7 fed from the feed reel 3 is wound in close contact the drum around the outer cylindrical surface thereof in the shape of a helicoid and thereafter goes into the inner space of the rotary drum 2 to be taken up on the take-up reel 4. In addition to that, a part of the outer cylindrical surface of the rotary drum 2 is constructed as a bearing structure 9, by which the abrasive tape 7 may be moved smoothly around the drum on and along the surface.

Figure 3:
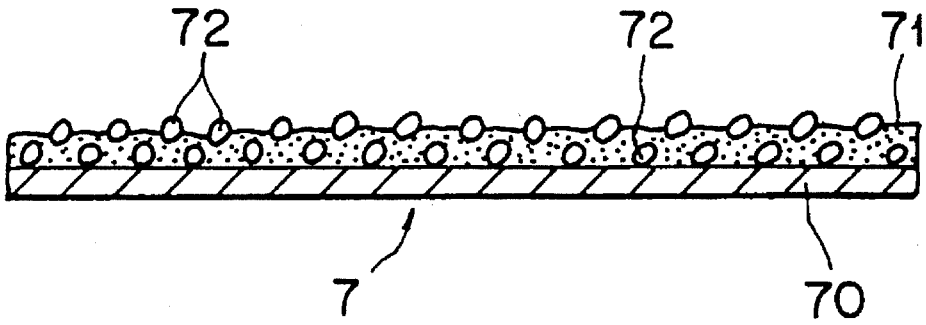
FIG. 3 is a schematic illustrative view in section of an abrasive tape used in an embodiment according to the present invention.
Figure 4:
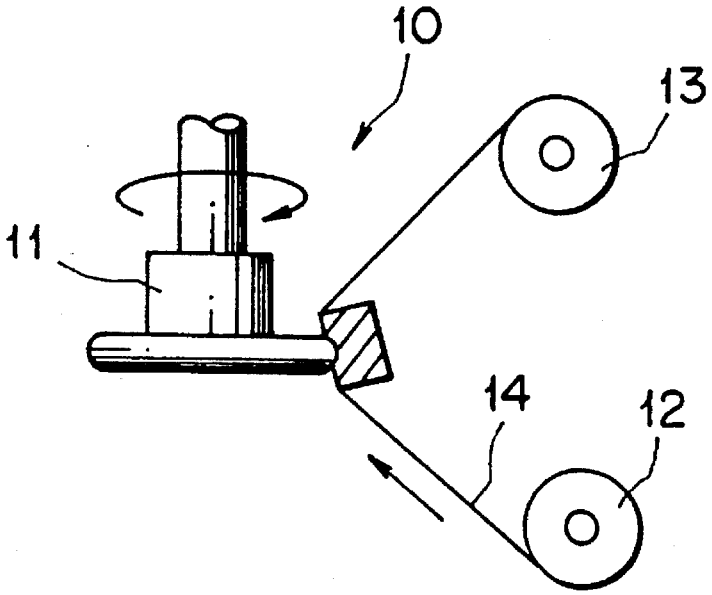
FIG. 4 is a schematic illustrative view of the construction of an apparatus for polishing the periphery portion of a wafer in the prior art.

Here a particular illustration of the tape 7 will be given in reference to a schematic sectional view of an abrasive tape as shown in FIG. 3. The tape 7 is composed such that fixed abrasive grains 72 are held on a flexible backing member 70 shaped as a tape with the help of an adhesive 71 applied thereon.

Figure 2:
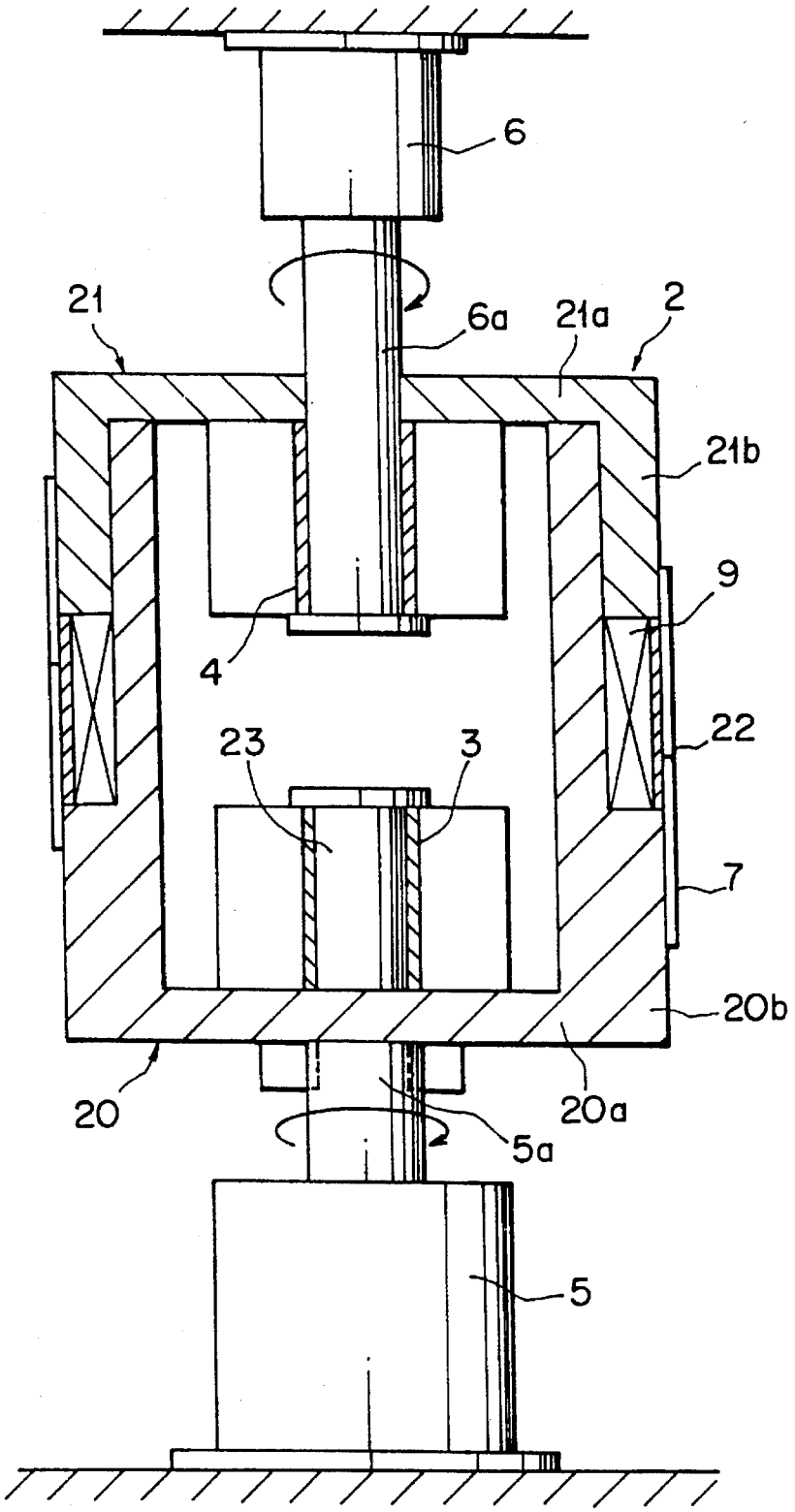
FIG. 2 is a vertical sectional view illustrating the construction of the rotary drum of an apparatus for polishing the peripheral portion of a wafer embodying the present invention.

Referring to FIG. 2 explained is the rotary drum 2. The drum 2 is constructed in a body out of a hollow cylindrical body 20 with an end plate 20*a* at an end thereof and another hollow cylindrical body 21 with an end plate 21*a* at an end thereof, where the cylindrical wall 20*b* of the first cylindrical body 20 is designed to exceed the cylindrical wall 21*b* of the second cylindrical body 21 in total dimension along a generating line thereof. In addition to that the cylindrical wall 20*b* has a larger outside diameter on the side of the lower end covered with the end plate 20*a* than that of on the opposite side. The part with the smaller outside diameter of the wall 20*b*, said part being half the total dimension, is constructed such that the top half part is arranged in a fitting relation with the inner wall surface of the second cylindrical body 21, the bottom half part has a bearing structure 9 the outermost surface of which a rubber sheet 22 is adhered to cover which is also in a fitting relation with the outer wall surface of the part with the smaller outside diameter of the wall 20*b*, where the bearing structure 9 may be that of a plain bearing or a roller bearing. A shaft 23 supporting a reel is vertically arranged on the end plate 20*a* of the first cylindrical body 20, on which the feed reel 3 is secured so as to be freely turnable and mountable or demountable. The shaft 5*a* of a motor 5 is fixed on the lower side of the end plate 20*a*. On the other hand another motor 6 is equipped above the second hollow cylindrical body 21. The shaft 6*a* of the motor 6 penetrates the end plate 21*a* into the inner space of the cylindrical body 21, where the shaft 6*a* is a shaft for supporting a reel and the part of the shaft 6*a* exposed to the inner space of the cylindrical body 21 has the take-up reel 4 secured thereon. As shown in FIG. 1, the outer cylindrical surfaces of the cylindrical bodies 20 and 21 have slits 24*a* and 24*b* respectively thereon, which are positioned at an angle or angles to generating lines thereof. The tape 7 is fed from the feed reel 3 to the outside of the drum 2 through the slit 24*a* , wound in close contact the cylindrical surface therearound in the shape of a helicoid and then led into the inside of the drum 2 through the slit 24*b* to be taken up by the take-up reel 4.

Next, a wafer holder mechanism 8 will be described in reference to FIG. 1. The wafer holder mechanism 8 comprises a wafer chuck 80 holding a wafer W by vacuum suction, a motor (not shown) for driving the vacuum chucked wafer W to turn, an air cylinder 82 actuates a stage 81 supporting thereon the wafer chuck 80 and the motor therefor. On a frame 83 having a plan view formed in the shape of a capital letter T, the wafer chuck 80, the motor therefor, the stage 81 and the air cylinder 82 are mounted. In the middle portion of the frame 83 the stage 81 is mounted such that it gets slidably closer to or farer away from the rotary drum 2. At the both ends the frame 83 is equipped with two brackets, one of which is connected to a bearing 84 through a shaft 86 and the other of which is also connected to the output shaft of a motor 85. The center lines of the bearing 84 and the motor 85 are adjusted to be almost in alignment with a tangential line passing the point of contact between the wafer and the outer cylindrical surface of the rotary drum 2. The peripheral portion of the wafer W may surely continue to be in contact with the tape 7 even regardless of changes of angular position of the wafer W.

Assembly and operation of the polishing apparatus of the above embodiment will be hereinafter explained.

At first, the feed reel 3 with the tape 7 wound for storage is set in the hollow cylindrical body 20 and the take-up reel 4 is also set in the hollow cylindrical body 21, when the cylindrical bodies 20 and 21 are left separate. The leading tip of the tape 7 stored in the feed reel 3 is pulled out through the slit 24*a* in the outer cylindrical surface of the cylindrical body 20, then manually wound the drum 2 loosely therearound in the shape of a helicoid and further the leading tip of the tape 7 is pulled in through the slit 24*b* in the outer cylindrical surface of the cylindrical body 21 to secure to the securing member of the take-up reel 4. Thereafter the bodies 20 and 21 are joined in slide fitting condition and then looseness of the tape 7 is minimized to the extent where the tape is tensioned enough to be in close contact on the surface of the drum 2 and still not damaged by the tension for the purpose by actuating the motor 6.

A wafer W is vacuum chucked on the wafer chuck 80 of the wafer holder mechanism 8 and the chamfer portion of the wafer W is made to be in contact with the tape 7 tightly wound the rotary drum 2 around the outer cylindrical surface thereof. On the contact of the wafer W to the drum 2, the rotary drum 2 is preferably already being rotated by the drive of the motor 5 and the wafer W is also preferably already being rotated by the motor (not shown). Besides the rotational direction of the rotary drum 2 and the moving direction of the tape 7 relative to the drum 2 are preferably the same at the contact point but even in the reverse case the periphery portion of the wafer W may well be polished in a practical sense according to the apparatus mentioned here.

The wafer W is continued to polish along the full peripheral portion under the conditions mentioned above. In this case, the wafer W is rotated in two ways at the same time, in one of which the wafer W is rotated about its center in order to make the polishing portion to move in and along the peripheral direction of the wafer W and in the other of which the wafer W is swung up or down around the contact point or the shaft 86 by the drive of the motor 85.

According to the polishing apparatus 1 thus constructed, the tape 7 is wound tight the rotary drum 2 therearound and is moving relative to the drum 2 by the revolution of the take-up reel 4, so that the tape 7 is continued to be fresh at the polishing point all the time of operation and besides the relative velocity between the chamfer and the tape 7 at the polishing point is kept large enough to effect the polishing by the revolution of the drum 2, where according to the present invention the relative velocity is preferred to be in the range of 50 m/min to 200 m/min, more preferably at about 100 m/min.

Consequently, a better polishing may be realized in a more stable conditions and the full width of a abrasive tape may be put into practical use to reduction of processing cost.

While there has been described what is at present considered to be most a preferred embodiment of the present invention, it will be understood that various modifications may be made therein and it is intended to cover in the appended claims all such modifications as fall within the true spirit and scope of the present invention.

For example, the axis of the rotary drum 2 may be inclined from a vertical line instead of the wafer W being inclined to the drum 2 vertically positioned.

What is claimed is :

1. An apparatus for polishing a periphery portion of a wafer, said wafer having two main face and the periphery portion, said apparatus comprising:

a tape holding fixed abrasive grains thereon;

a feed reel for feeding the tape stored by winding said feed reel;

a take-up reel for taking up the tape by winding said take-up reel;

a rotary drum inside of which both of the reels are equipped in such a manner that they are mountable or demountable, where a portion of the tape on the way from the feed reel to the take-up reel is adaptive to wind around the outer cylindrical surface of the rotary drum in close contact and in the shape of a helicoid and one of the main faces of the wafer is positioned to be in a plane intersecting the central axis of the rotary drum at an angle.

2. An apparatus for polishing the periphery portion of a wafer according to claim 1 which further includes a wafer holder mechanism comprising:

a wafer chuck rotatable about its axis of rotation;

a third motor for supporting thereon the wafer chuck and the motor therefor and for positioning the wafer relative to the rotary drum;

a fourth motor for driving the stage and thereby making the wafer chuck holding the wafer thereon to get closer to or farther away from the rotary drum; and a fifth motor for driving the stage and thereby making the wafer to position such that one of the main faces of the wafer inclines up or down at an angle to plane intersecting perpendicularly the axis of rotation of the rotary drum.

3. An apparatus for polishing a periphery portion of a wafer according to any of claims 1 which further includes a plurality of slits arranged in the outer cylindrical surface of the rotary drum so as to be positioned almost in parallel with a generating line of the outer cylindrical surface.

4. An apparatus for polishing the periphery portion of a wafer according to claim 3 wherein the slits are oriented to be on or in parallel with the bisector of the angle between a generating line and a direction of the tape width.

5. An apparatus for polishing the periphery portion of a wafer according to claim 3 wherein a part of the outer cylindrical surface of the rotary drum is constructed out of a bearing structure, the outer cylindrical surface of which is freely turnable in a direction perpendicular to a generating line of the cylindrical surface of its own.

6. An apparatus for polishing the periphery portion of a wafer according to claim 5 wherein the outer cylindrical surface is composed of an elastic substance.

* * * * *